United States Patent [19]

Silvestre

[11] 4,031,943

[45] June 28, 1977

[54] SYSTEM FOR HANGING CURTAINS

[76] Inventor: Sabino Silvestre, Madrid, Spain

[22] Filed: May 3, 1976

[21] Appl. No.: 682,786

[52] U.S. Cl. ..... 160/330; 160/348; 248/264

[51] Int. Cl.[2] ..... A47H 1/00; A47H 13/14

[58] Field of Search ..... 160/330, 345, 346, 347, 160/348, 349; 16/87 R, 87.2, 87.4 R, 87.4 W, 87.6 R, 87.6 W, 93 R, 93 D, 94 R, 94 D, 95 R, 95 W, 95 D, 96 R; 248/264

[56] References Cited

UNITED STATES PATENTS

| | | | |
|---|---|---|---|
| 365,203 | 6/1887 | Schastey | 160/346 |
| 905,142 | 12/1908 | Bond | 248/264 |
| 1,227,019 | 5/1917 | Thompson | 248/264 |
| 3,114,412 | 12/1963 | Lishman | 160/348 |
| 3,388,734 | 6/1968 | Silvestre | 160/348 |

*Primary Examiner*—Peter M. Caun
*Attorney, Agent, or Firm*—Cushman, Darby & Cushman

[57] ABSTRACT

This invention relates to an improved system for hanging curtains, whereby the points from which the curtain is hung are held a maximum spaced distance from one another determined when the curtain is extended, but in such manner that the curtain can slide freely along the length of the supporting bar without being obstructed by the intermediate supports which fasten the bar to the ceiling or to the side wall, when the curtain is gathered or extended, which supports are inserted in and run the length of a longitudinal slot made in said bar. For this purpose the top of the curtain contains some circular holes open at the top, over which are placed some metal rings likewise open at the top which simultaneously imprison between their flanges the fabric of the curtain top and some flat rings of plastic or similar material which also are open at the top, the lower portion of which is prolongated by means permitting regulation as desired of the distance between said rings and consequently the width of the gathers of the curtain.

7 Claims, 8 Drawing Figures

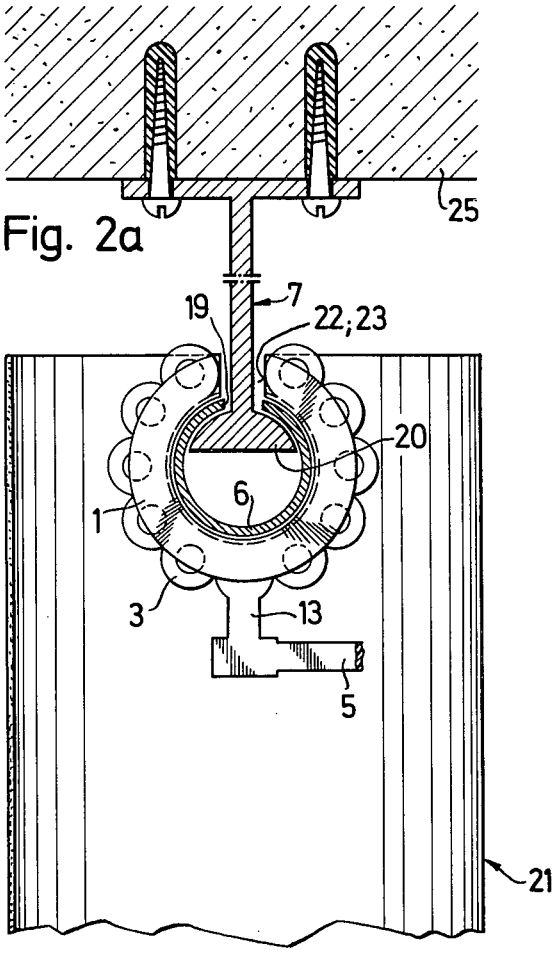
Fig. 2a
Fig. 2c
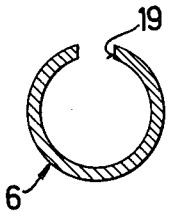
Fig. 2d
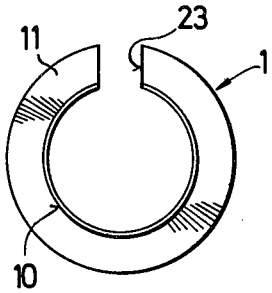
Fig. 2b
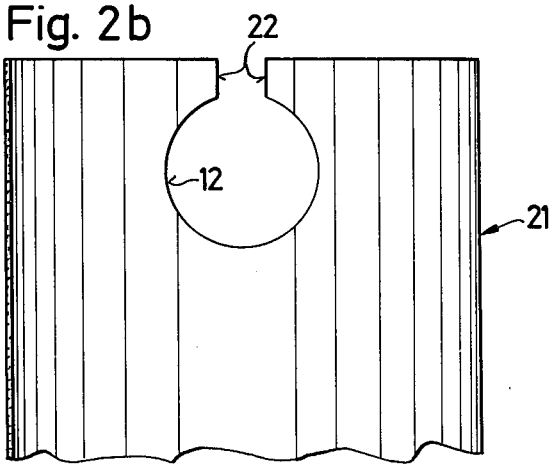
Fig. 2e
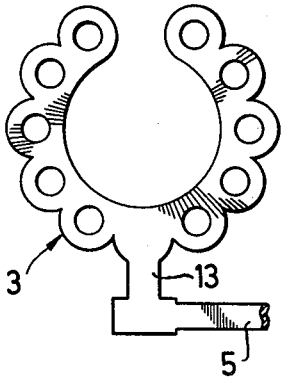

SYSTEM FOR HANGING CURTAINS

In U.S. Pat. No. 3,155,150 issued to the applicant on Nov. 3, 1964 and in Argentine Pat. No. 140.048, there is disclosed a device for hanging and gathering slidable curtains which comprises a row of aligned eyelets engageable by a supporting bar, a plurality of flexible tongues, each connecting together an adjacent pair of eyelets, and a strip member connecting said tongues together and holding said pairs of eyelets in face-to-face relation for gathering the curtain.

In U.S. Pat. No. 3,388,734 issued also to the applicant on June 18, 1968 and in Argentine Pat. No. 144.740, there is disclosed a device which does not require a strip member for gathering the curtain, said gathering being obtained exclusively through the action of a particular arrangement of flexible tongues connecting together adjacent pairs of eyelets.

In Argentine Pat. No. 164.291, additional to Argentine Pat. No. 144.740, there are disclosed some members for linking or connecting together adjacent pairs of eyelets consisting of respective tongues, one of which contains at least one rectangular-shaped orifice, while the other tongue, of uniform width, passes exactly through said rectangular-shaped orifice and bears, on its edges, facing pairs of wedge-shaped prongs.

In Argentine Pat. No. 185.094, additional to Argentine Pat. No. 144.740, there are disclosed other members for connecting together adjacent pairs of eyelets likewise consisting of respective tongues connected to said orifices, which bear a series of orifices arranged in face-to-face relation over the tongues and a flat member having a tailpiece insertable in one of the pairs of facing orifices.

In Argentine Pat. No. 192.672, additional to Argentine Pat. No. 164,291, there are disclosed certain improvements in the system of mutual gripping of said tongues.

When the hanging bar which supports the curtain is of very long span it is necessary, as is known, to affix supports to the ceiling or to the side wall to prevent the bar from bending; however, none of the previously disclosed systems permits the curtain to slide fully and freely, by reason of the obstacles represented by said supports.

The principal object of this invention is a system for hanging curtains in such manner that the points from which the curtain is hung are kept a spaced maximum distance from one another determined when the curtain is extended, but in order that the curtain can freely slide the full length of the supporting bar without being obstructed by the intermediate supports which fasten the bar to the ceiling or to the side wall when the curtain is gathered or extended, which supports are inserted in and run the length of a longitudinal slot made in said bar.

For this purpose the top of the curtain contains some circular holes which are open at the top, and the members connecting said holes together are also open at the top so that when the curtain hung from said members slides, it does not strike the ceiling or wall-fastened intermediate supports which support the bar.

Another object of this invention is an improved device for connecting said holes together, consisting of some metal rings open at the top which simultaneously imprison between their flanges the fabric of the top of the curtain and some flat rings of plastic or similar material, also open at the top, the lower portion of which is prolongated by means which permit regulation as desired of the distance between said rings, and consequently of the width of the gathers of the curtain.

In order that the invention may be more clearly understood and readily carried into practice, one of the preferred embodiments thereof has been illustrated by way of example in the accompanying drawings, in which:

FIG. 1 is a fragmentary perspective view of the curtain-hanging system in exploded arrangement of the parts as assembled for use.

FIG. 2*a* is a plan view of the device formed by the metal ring which imprisons the fabric and the plastic ring between its flanges and is hung from the supporting bar, accompanied by an exploded illustration (FIGS. 2*c*, 2*d*, 2*e*) of the elements of said device, further FIG. 2*b* shows the upper part of the curtain.

The same reference characters are used to indicate like of corresponding parts or elements throughout the drawings.

Figure 1:
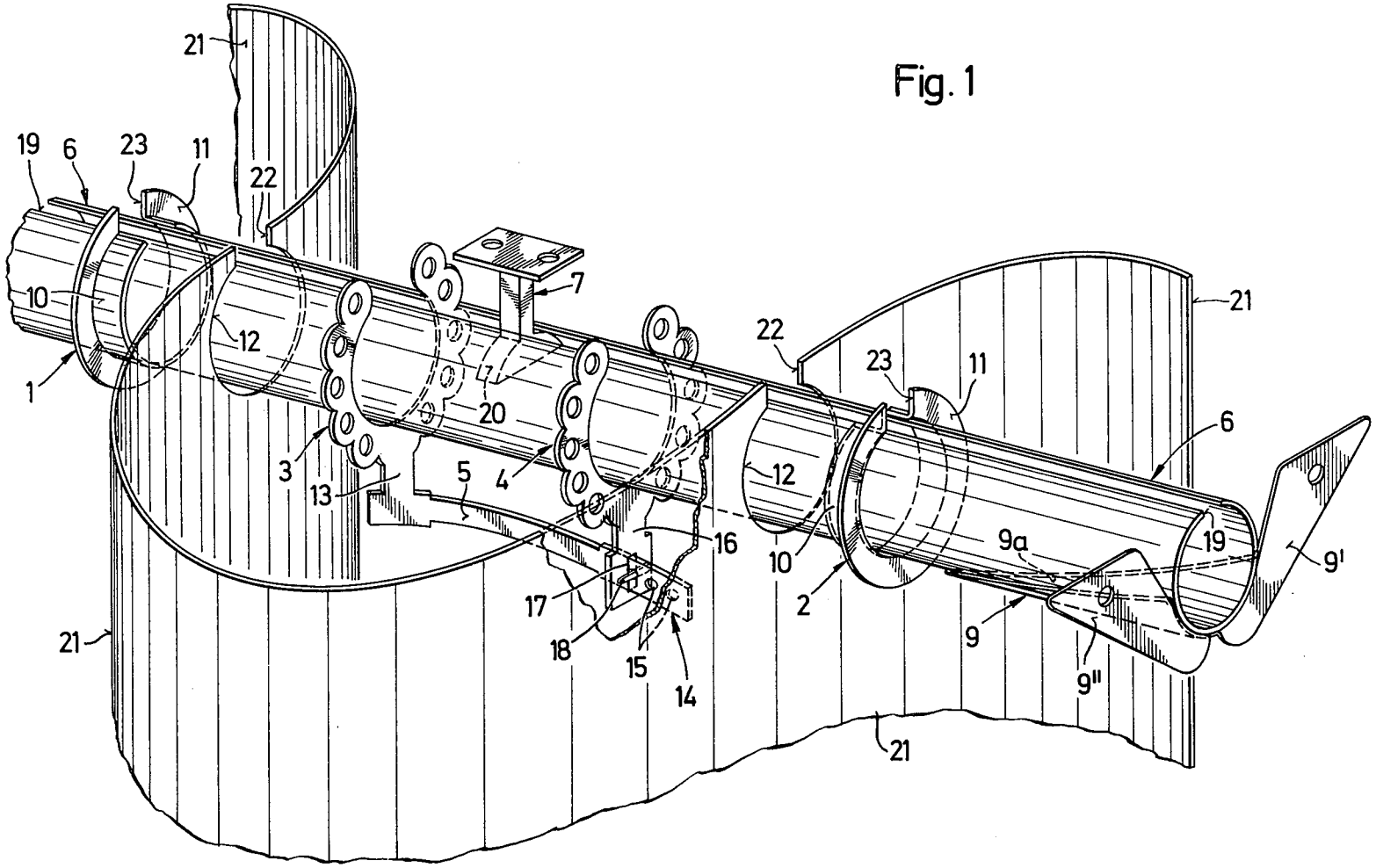
Figure 3:
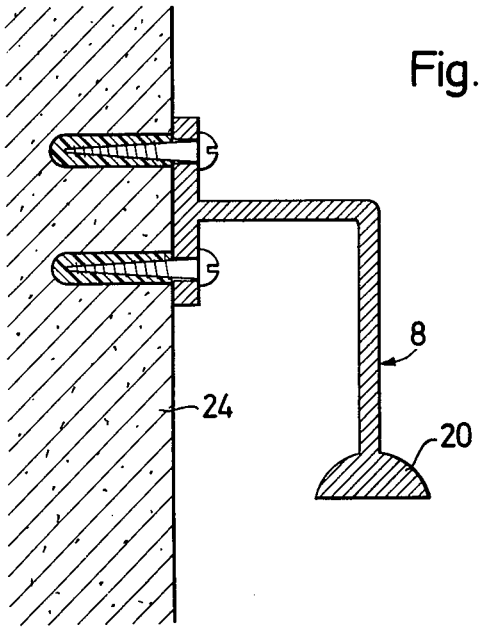
FIG. 3 is a representation of an intermediate support fastening the supporting bar to a side wall.

With reference to the drawings, and particularly to FIG. 1, FIG. 2*a*, *b*, *c*, *d*, *e* and FIG. 3 thereof, the system is formed on one hand by the device comprising the metal rings 1 and 2, complemented by the two plastic rings 3 and 4 (which latter are joined by a one-piece plastic strip or band 5), and on the other hand by the bar 6 along with its supports 7, 8 and 9 for fastening to the ceiling 25 or to the side walls 24, and end walls.

For putting this invention into practice, the upper part of the circular-section curtain bar 6 bears a longitudinal slot 19 having a width approximately equal to a fifth of the external diameter of the tubular bar. The purpose of this slot is to enable the insertion therein of some intermediate supports 7 and 8 which will be anchored to the ceiling of wall (FIG. 3) and whose aim is to have the bar hung from above rather than supported from below or to the side, to thus prevent the bar from bending due to the weight of the curtain. The number of intermediate supports will vary, naturally, with the length of the bar. In addition, the ends of the bar can be provided with bracket supports 9 upon which the ends of the bar can rest for support.

The supports 7 which are anchored to the ceiling by known means are of double-T shape, although the crossbar 20 of the inverted or lower T is of circular segment shape so that the tubular part 6 may rest upon it; the width of the vertical shank of said double-T will be slightly less than the width of the slot 19 in the tubular bar, so that said support can be inserted in said slot from one end of the bar.

Some circular holes 12 with slots 22 are made in the top or upper portion of the curtain 21 at very slight distance from the upper edge of the curtain 21 and uniformly spaced from one another. Also, that part of the curtain 21 fabric immediately above said circular holes 12 (FIG. 2*b*) is cut away, to a width approximately equal to a fifth of the diameter of the hole made in the fabric.

The metal clamping of fastening rings 1 and 2 (FIG. 2*d*) are formed by and approximately cylindrical part 10 of relatively short length bearing a radial flange 11 at one of its ends. The external diameter of said cylindrical surface 10 is slightly less than the diameter of the holes 12 made in the fabric at the top of the curtain 21. The said metal rings are open at the top (23), leaving a free space of a width approximately one fifth of the internal diameter of said rings.

The two flat rings 3 and 4 of plastic or similar material are of identical shape. One of them, ring 3, is extended downward at its bottom by a vertical length 13 which turns at right angles in the plane of the ring and extends in another length or section to form a one-piece strip or band 5, which ends in a slightly wider part 14 provided with various holes 15. The bottom of the other ring 4 also extends downward in a similar vertical length 16 which is slightly longer than the vertical length 13 of the other ring 3. Said vertical length 16 has a widened or enlarged area provided with a vertical slit 17. The size of said vertical slit 17 and the length of the vertical section 16 are such, in relation to the length of the vertical section 13 of the other ring, that when the two rings 3 and 4 are placed over the holes in the fabric at the top of the curtain, the upper portion of said rings 3 and 4 being aligned at the same height, the one-piece strip 5 extending from ring 3 can be inserted with ease in the slit 17 of ring 4.

For coupling ring 3 to ring 4 there is a spindle 18 whose length is greater than the width of slit 17, with the result that a small buckle is formed in which the enlarged portion 14 of the one-piece strip 5 of the first ring 3 is inserted in slit 17 and held fast by passing said buckle spindle 18 through the desired hole 15. The plastic rings 3 and 4 are open at the top, leaving a free space of a width approximately one fifth of the internal diameter of said plastic rings.

To fasten or hang the curtain, the cylindrical parts 10 of the metal rings 1 and 2 are inserted, from the visible side of the curtain and in an inward direction, in every two consecutive holes 12 made in the top of the curtain, the radial flange 11 of said two metal rings 1 and 2 being applied to the outer side of the curtain top. Once this operation is completed, the plastic rings 3 and 4 are inserted, on the inner or non-visible side of each gather in the curtain, in said two consecutive holes 12 in the curtain top which already hold the metal rings 1 and 2, said plastic rings 3 and 4 being fitted over the cylindrical surface 10 of said metal rings; said cylindrical body 10 is then bent outward and over the curtain, with a suitable tool, to form a second flange which thus perfectly secures and imprisons said plastic rings 3 and 4. The curtain, along with the plastic rings, thereby remains sandwiched and imprisoned between flange 11 and the second parallel flange thus formed from the bent cylindrical body 10.

Once the curtain is secured between the flanges of the metal rings 1 and 2 it can be hung from the bar by passing the latter through said rings 1 and 2, and as there is no direct friction between the curtain and the bar, the only friction contact being between the bar and the metal rings 1 and 2, the curtain does not tear on deteriorate and slides smoothly.

The reason for the opening in the upper part of the curtain fabric, of the metal rings 1 and 2 and of the plastic rings 3 and 4, of a width slightly greater than the width of the slot in the upper part of the bar, is to be able to achieve free sliding of the metal rings supporting the curtain without their striking the intermediate ceiling or wall supports which hold the bar secure.

To adjust or regulate the distance separating two consecutive holes 12, greater or lesser length of the onepiece strip 5 of the plastic ring 3 is inserted in the buckle 17 of the plastic ring 4 and a suitable hole 15 is chosen for inserting therein the buckle spindle 18, thereby establishing the desired width of the gathers of the curtain.

Figure 4:
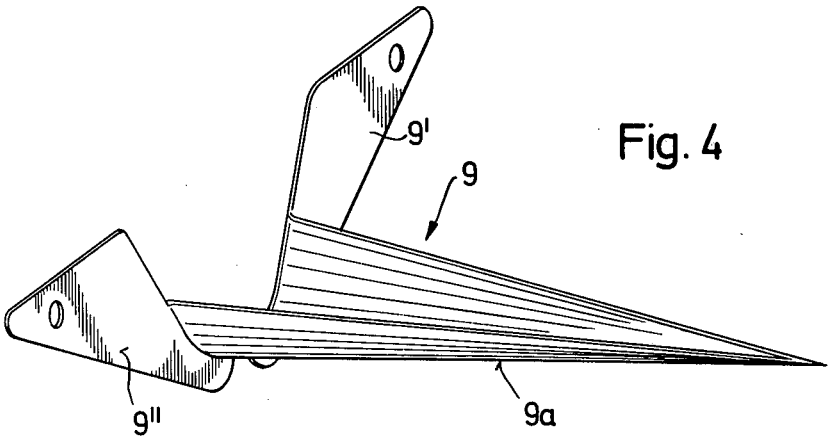
FIG. 4 illustrates a support for placement at the extreme end of the supporting bar.

FIG. 4 illustrates a support 9 for placement at the extreme end of the supporting bar 6. The support 9 consists of a middle supporting part 9*a* and flanges 9′,9″.

What is claimed:

1. In a system for hanging gathered curtains: a horizontal tubular suspension rod having a longitudinal slot running the length of the upper side of the tubular rod; means for supporting the tubular rod from a fixed surface including at least one intermediate support member having an enlarged portion housed within the interior of the tubular rod and a narrow portion extending through the slot for fastening to the fixed surface; a curtain having a top portion provided with a plurality of holes through which the rod extends, each of said holes having a portion extending to the upper edge of the curtain to form a slot in said upper edge of a width slightly greater than the thickness of said narrow portion of said support member so that the curtain can slide past the said support member; each pair of adjacent holes in said top portion of the curtain being provided with a pair of curtain-gathering ring assemblies one of which is fastened to the curtain at the location of one of the holes and the other being fastened to the curtain at the location of the other hole of the pair, each of said ring assemblies having a radial slot therethrough and conforming to its respective curtain hole; and linking means of adjustable length connecting one ring assembly with the other of the pair.

2. A system as in claim 1 wherein each of the ring assemblies for linking the pairs of adjacent curtain holes includes an approximately cylindrical metal ring having a radial slot the width of which is slightly greater than the width of the slot in the suspension rod, said metal ring being inserted from the outer side of the curtain into the respective curtain hole, and is further formed by a flat ring of plastic material likewise having a radial slot and placed opposite said metal ring on the inner side of the curtain.

3. A system as claimed in claim 2 wherein the metal ring includes a radial flange applied to the outer side of the curtain the flat plastic ring on the inner side of the curtain being fitted over the cylindrical ring to thus press against the material of the curtain on the inner side of the curtain top, the innermost edge of said cylindrical ring subsequently being bent outward over the flat plastic ring to thus form a second flange which in cooperation with said radial flange simultaneously sandwich between them both the plastic ring and the material of the curtain.

4. A system as claimed in claim 1 wherein the holes in the curtain top are provided only a very slight distance from the upper edge of the curtain.

5. A system as in claim 3 wherein the bottom portion of one of the flat plastic rings in each ring assembly extends downward in the form of a one-piece strip which turns at right angles in the plane of the ring and terminates in a widened part provided with several orifices, the bottom portion of the flat plastic ring in the other ring assembly also extending downward in the form of a vertical strip of approximately the same length as the vertical strip of the first plastic ring and having a widened part provided with a vertical slit, from one side of which a central spindle protrudes the length of which is greater than the width of the slit, a small buckle thereby being formed in which the widened part of the strip of the first plastic ring is inserted and held fast by inserting said buckle spindle in the desired orifice.

6. A system as in claim 1 wherein said intermediate support which anchors the suspension rod to the ceiling or wall is of double-T shape, the crossbar of the inverted or lower T forming a semi-circular segment which can be inserted in the suspension rod.

7. A system as in claim 1 including end supports which support the ends of the rod, said end supports having a zone for supporting the underside of the rod of a conical segment shape.

* * * * *